US006539918B1

(12) United States Patent
Pursifull

(10) Patent No.: US 6,539,918 B1
(45) Date of Patent: Apr. 1, 2003

(54) ELECTRONIC THROTTLE SERVO HARD STOP DETECTION SYSTEM

(75) Inventor: Ross Dykstra Pursifull, Dearborn, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/974,268

(22) Filed: Oct. 9, 2001

(51) Int. Cl.[7] ..... F02D 9/10
(52) U.S. Cl. ..... 123/399; 123/397
(58) Field of Search ..... 123/399, 397

(56) References Cited

U.S. PATENT DOCUMENTS 5,947,086 A * 9/1999 Hoshino et al. ..... 123/399
5,992,383 A * 11/1999 Scholten et al. ..... 123/399

* cited by examiner

*Primary Examiner*—Erick Solis
(74) *Attorney, Agent, or Firm*—John E. Kajander

(57) ABSTRACT

A method for controlling a positioning device (34) of an internal combustion engine includes providing an electric motor (30) for actuating the positioning device (34). The positioning device (34) is commanded to change to a commanded position. A control effort required to change to the commanded position is then detected. Whether the control effort exceeds a threshold for a predetermined time period is determined. The control effort is reduced when the control effort exceeds the threshold for the predetermined time period. Each full stop position is relearned each time a close stop is commanded.

25 Claims, 4 Drawing Sheets

ELECTRONIC THROTTLE SERVO HARD STOP DETECTION SYSTEM

TECHNICAL FIELD

The present invention relates generally to control systems for internal combustion engines, and more particularly, to an electronic throttle servo hard stop relearning system.

BACKGROUND ART

Many previously known motor vehicle throttle control systems have a direct physical linkage between an accelerator pedal and the throttle body so that the throttle plate is pulled open by the accelerator cable as the driver presses the pedal. The direct mechanical linkages include a biasing force that defaults the linkage to a reduced operating position, in a manner consistent with regulations. Nevertheless, such mechanisms are often simple and unable to adapt fuel consumption efficiency to changing traveling conditions. Moreover, these mechanisms add significant weight and components to the motor vehicle.

An alternative control for improving throttle control and the efficient introduction of fuel air mixtures into the engine cylinders is presented by electronic throttle control. The electronic throttle control includes a throttle control unit that positions the throttle plate by an actuator controlled by a microprocessor based on the current operating state determined by sensors. The processors are often included as part of a powertrain electronic control that can adjust the fuel air intake and ignition in response to changing conditions of vehicle operation as well as operator control. Protection may be provided so that an electronic system does not misread or misdirect the control and so that unintended operation is avoided when portions of the electronic control suffer a failure.

Typically, the actuator or servomotor used to position the throttle plate is designed to have the maximum control effort available (motor voltage, current, duty cycle) to enhance throttle plate position response. Having a large control effort continuously available or available for maximum effort could possibly lead to overstressing the system's physical components if a blockage of the throttle plate occurs or if the throttle is commanded to a mechanical limit, such as the close stop or open stop. Specifically, the H-driver and the servomotor could overheat with sustained full control effort under some environmental conditions. In an effort to avoid permanent damage, most electronic systems shut down when they get to a threshold temperature.

Additionally, typical prior art electronic throttle controllers only learn the closed stop position upon power-up or power-down of the throttle controller.

The disadvantages associated with these conventional electronic throttle overheat protection techniques have made it apparent that a new technique for electronic throttle overheat protection is needed. The new technique should allow full control effort while preventing overheat conditions. Additionally, the new technique should continuously learn the open stop position and the close stop position to prevent the throttle plate from striking a detent at high speed, thereby risking damage to the device. Detecting on-line compensates for variations in detent location due to thermal expansion, thermal contraction, and thermal drift in the feedback source, the throttle position sensors. The present invention is directed to these ends.

SUMMARY OF THE INVENTION

It is, therefore, an object of the present invention to provide an improved and reliable electronic throttle servo temperature protection system. Another object of the present invention is to allow full control effort while preventing overheat conditions. Additionally, the present invention should continuously learn the closed stop position. It is yet another object of the present invention to detect the mechanical limits not only at power up or power down, but also online.

In accordance with the above and other objects of the present invention, an electronic throttle servo hard stop relearning system is provided. In one embodiment of the invention, a method for controlling a positioning device of an internal combustion engine is provided. The method includes providing an electric motor for actuating the positioning device. The positioning device is commanded to change to a commanded position. A control effort required to change to the commanded position is then detected. Thereafter, whether the control effort exceeds a threshold for a predetermined time period is determined. The control effort is reduced when the control effort exceeds the threshold for the predetermined time period. Each full stop position is relearned each time such stop is commanded for a given duration.

The present invention thus achieves an improved electronic throttle servo hard stop detection system system. The present invention is advantageous in that it will not cause mechanism failure or require significant and costly added robustness to the mechanism.

Additional advantages and features of the present invention will become apparent from the description that follows, and may be realized by means of the instrumentalities and combinations particularly pointed out in the appended claims, taken in conjunction with the accompanying drawings.

BRIEF DESCRIPTION OF THE DRAWINGS

In order that the invention may be well understood, there will now be described some embodiments thereof, given by way of example, reference being made to the accompanying drawings, in which.

BEST MODES FOR CARRYING OUT THE INVENTION

The present invention is illustrated herein with respect to an electronic throttle servo hard stop detection system system, particularly suited for the automotive field. However, the present invention is applicable to various other uses that may require electronic throttle servo hard stop detection system systems.

Figure 1:
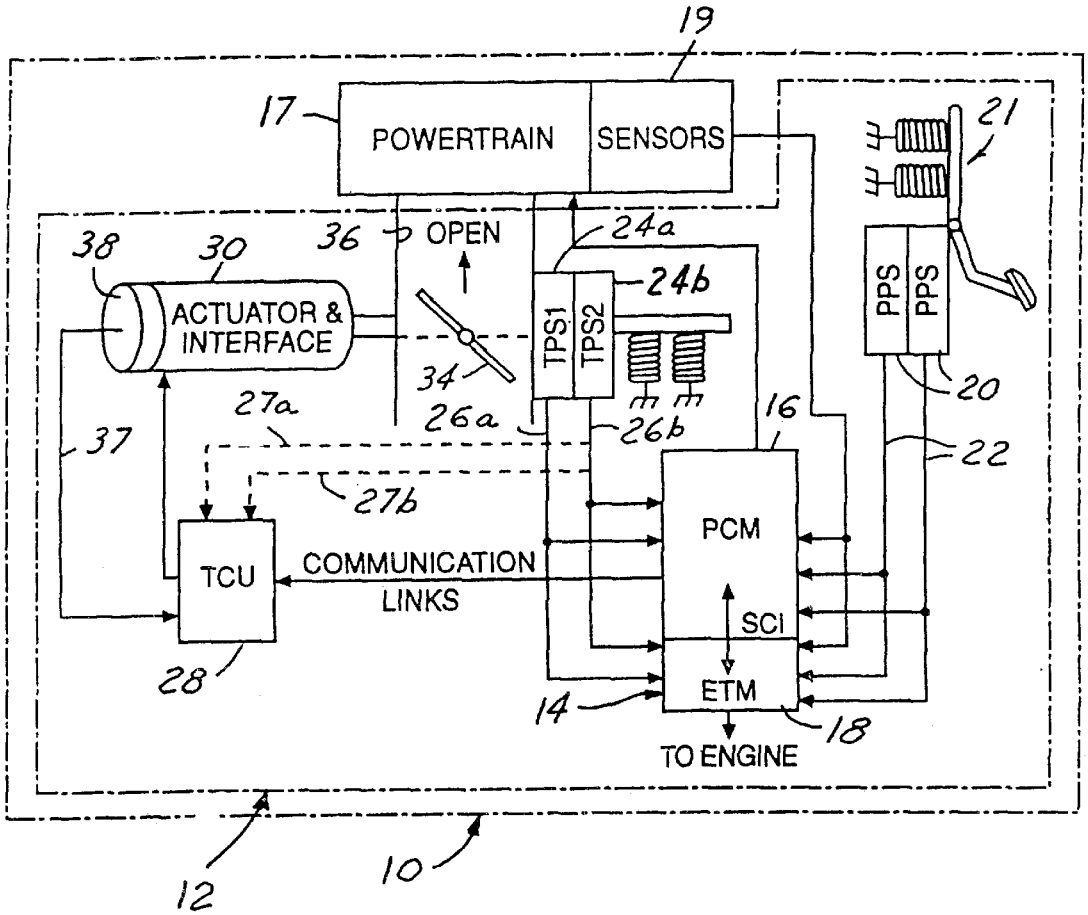
FIG. 1 is a schematic illustration of a block diagram of an electronic throttle servo hard stop detection system in accordance with one embodiment of the present invention.

Referring to FIG. 1, a motor vehicle powertrain system 10, including electronic throttle control system 12, includes an electronic control unit 14. In the preferred embodiment, the electronic control unit 14 includes a powertrain control module (PCM) 16, including a main processor and an electronic throttle monitor (ETM) 18, including an independent processor. The PCM and ETM each share sensors 19 and actuators that are associated with the powertrain system 17 and control module 16. Preferably, the electronic throttle monitor 18 includes a processor physically located within the powertrain control module housing, although a separate housing, separate locations and other embodiments can also be employed in practicing the invention. Moreover, while the electronic throttle monitor 18 and the powertrain control module 16 have independent processors, they share the inputs and outputs of powertrain sensors 19 and actuators 21 and 34, respectively, for independent processing.

A wide variety of inputs are represented in the diagram of FIG. 1 by the diagrammatic representation of redundant pedal position sensors 20. The sensors 20 are coupled through inputs 22 and are representative of many different driver controls that may demonstrate the demand for power. In addition, the electronic control unit 14 includes inputs 26*a* and 26*b* for detecting throttle position. A variety of ways for providing such indications is diagrammatically represented in FIG. 1 by a first throttle position sensor 24*a* and a redundant second throttle position sensor 24*b* to obtain a power output indication. As a result of the many inputs represented at 19, 22, 26*a* and 26*b*, the electronic controller 14 provides outputs for limiting output power so that output power does not exceed power demand. A variety of outputs are also diagrammatically represented in FIG. 1 by the illustrated example of inputs to a throttle control unit 28 that in turn powers an actuator and motor interface 30 for displacing the throttle plate 34. For example, an actuator and interface may comprise redundant drive motors powering a gear interface to change the angle of the throttle plate 34 in the throttle body 36.

Likewise, the responsive equipment like motors may also provide feedback. For example, the motor position sensor 38 or the throttle position sensors 24*a* and 24*b* may provide feedback to the throttle control unit 28, as shown at 37, 27*a* and 27*b*, respectively, to determine whether alternative responses are required or to maintain information for service or repair.

Figure 2A:
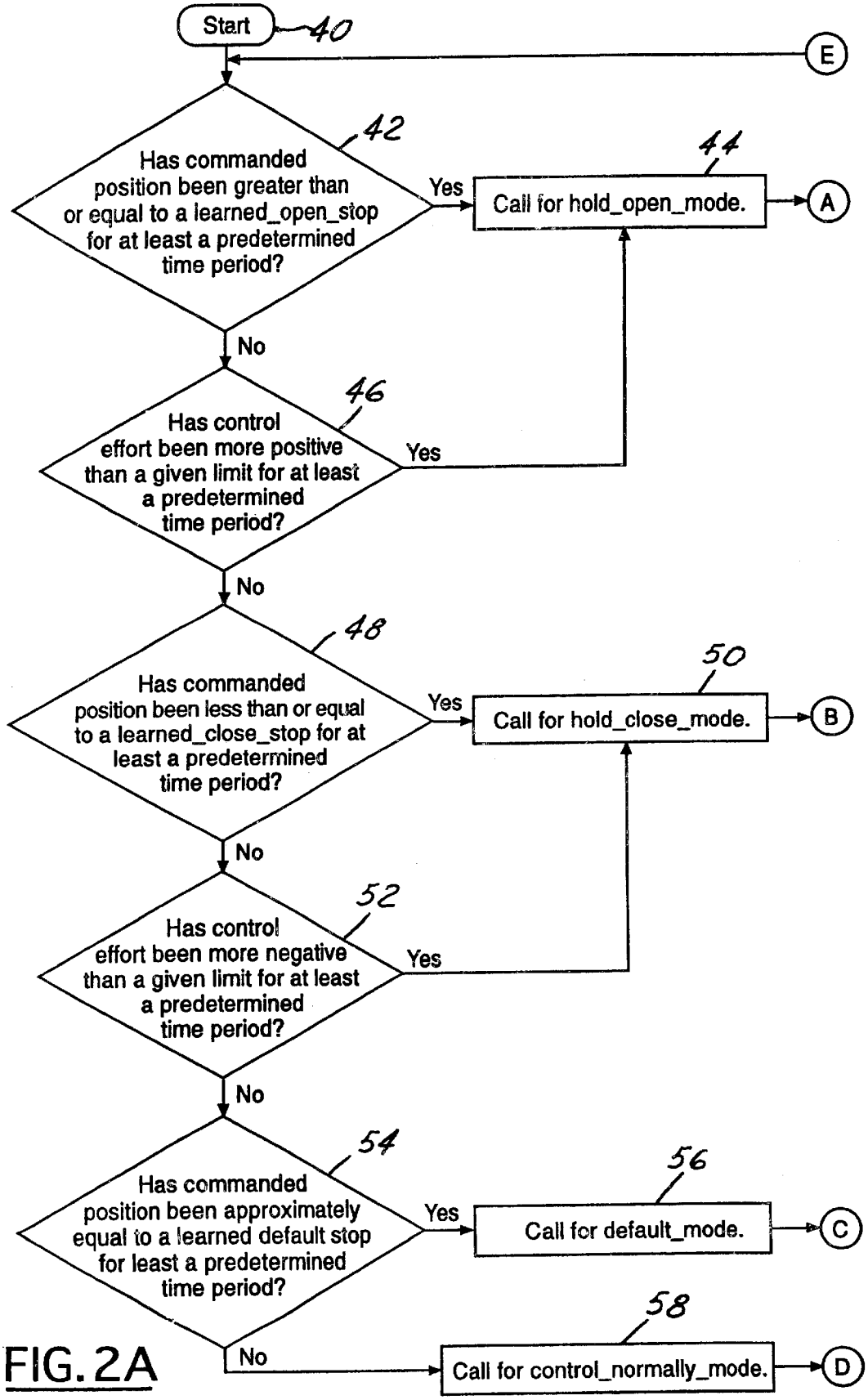
FIG. 2A is a flow chart depicting a method of providing electronic throttle servo hard stop detection system in accordance with one embodiment of the present invention.

Referring to FIG. 2A, a flow chart depicting a method of providing an electronic throttle servo hard stop detection system in accordance with one embodiment of the present invention is illustrated. In operation, the method begins with step 40 and immediately proceeds to step 42. In step 42, the controller determines if the commanded position has been greater than or equal to a learned open stop for at least a predetermined time period. Typically, an initial learned open stop has a value in a range from 80 to 110 degrees. A typical predetermined time period is 200 milliseconds. If the commanded position has been greater than the learned open stop, then the sequence proceeds to step 44. In step 44, the controller calls for a hold open mode. Step 44 is discussed in more detail in the description for FIG. 2B.

If in step 42 the commanded position has not been greater or equal to the learned stop, then the sequence proceeds to step 46. In step 46, the controller determines if the control effort has been more positive than a predetermined limit for at least a predetermined time period. Typically, an effort limit of approximately +6 volts and a contiguous time interval of about 300 milliseconds are used. If the predetermined threshold has been exceeded for a predetermined duration, then the sequence proceeds to step 44.

However, if in step 46 the predetermined threshold has not been exceeded, then the sequence proceeds to step 48. In step 48, the controller determines if the commanded position has been less than or approximately equal to a learned close stop for at least a predetermined time period. Typically, an initial learned close stop has a value in a range from 4 to 12 degrees. A typical predetermined time period is 200 milliseconds. If the commanded position has been less or equal, then the sequence proceeds to step 50. In step 50, the controller calls for a hold close mode. Step 50 is discussed in more detail in the description for FIG. 2C.

If in step 48 the commanded position has not been less or equal to the learned stop position, then the sequence proceeds to step 52. In step 52, the controller determines if the control effort has been more negative than a predetermined limit for at least a predetermined time period. Typically, an effort limit of approximately −6 volts and a contiguous time interval of about 300 milliseconds are used. If the predetermined threshold has been exceeded, then the sequence proceeds to step 50.

However, if in step 52 the predetermined threshold has not been exceeded, then the sequence proceeds to step 54. In step 54, the controller determines if the commanded position has been approximately equal to a learned default stop for at least a predetermined time period. Typically, an initial learned default stop has a value in a range from 6 to 10 degrees greater than the close stop angle.

If in step 54 the commanded position is approximately equal to a learned default, then the sequence proceeds to step 56. In step 56, the controller calls for a default mode. Step 56 is discussed in more detail in the description for FIG. 2D.

If, however, the commanded position is not approximately equal to the learned default, then the sequence proceeds to step 58. In step 58, the controller calls for control normal mode. Step 58 is discussed in more detail in the description for FIG. 2E.

Figure 2B:
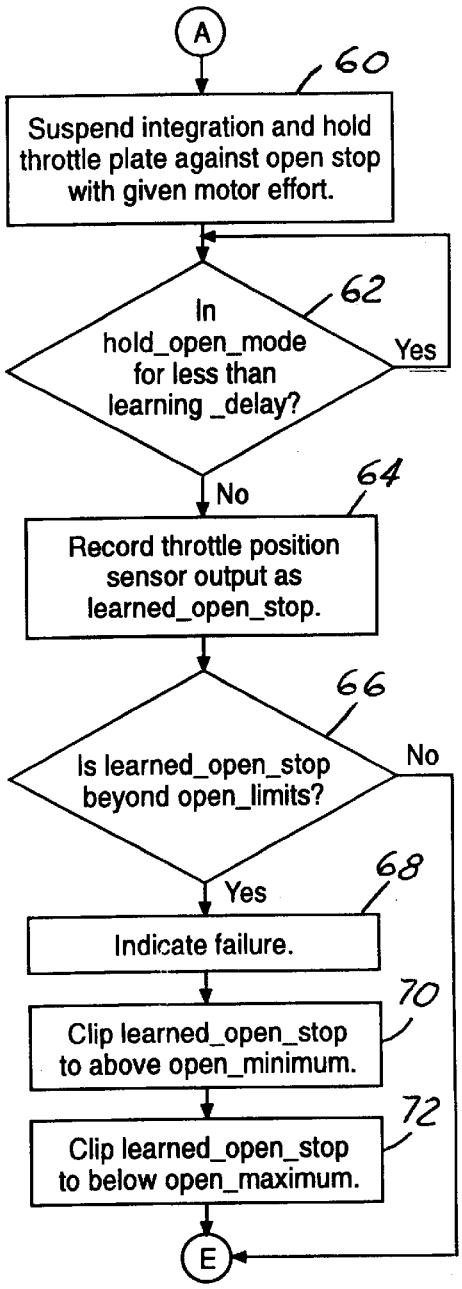
FIG. 2B is a flow chart depicting a method of providing electronic throttle servo hard stop detection system for a hold open mode in accordance with one embodiment of the present invention.

Referring to FIG. 2B, a flow chart depicting a method of providing electronic throttle servo hard stop detection system for a hold open mode in accordance with one embodiment of the present invention is illustrated. The hold open mode sequence begins with step 60 by suspending integration and assuming open loop control mode. In this step, the controller transitions from a closed loop control mode to an open loop control mode. Once the controller has shifted to the open loop control mode, the throttle motor holds the throttle plate against the open stop. Then, the sequence then proceeds to step 62.

In step 62, the controller determines if the throttle plate has been in hold open mode for less than a learning delay. The learning delay allows for the throttle plate to stabilize and typically lasts for about 60 milliseconds. Once the learning delay has expired, the sequence proceeds to step 64.

In step 64, the controller records the throttle position sensor output as the learned open stop. The sequence then proceeds to step 66.

In step 66, the controller determines if the learned open stop is beyond a predetermined limit. For example, the open stop limits may include a minimum of 80 degrees and a maximum of 110 degrees. If the controller determines that the learned open stop is within these limits, the sequence immediately proceeds to step 42. If, however, the learned open stop is beyond these limits, then the sequence proceeds to step 68.

In step 68, the controller indicates a failure. The sequence then proceeds to steps 70 and 72. In these steps, the controller clips the learned open stop so as to restrict the learned open stop to a range above an open stop minimum and below an open stop maximum. A typical open stop minimum has a value of 80 degrees, and a common open stop maximum has a value of 110 degrees. Then, the sequence returns to step 42.

Figure 2C:
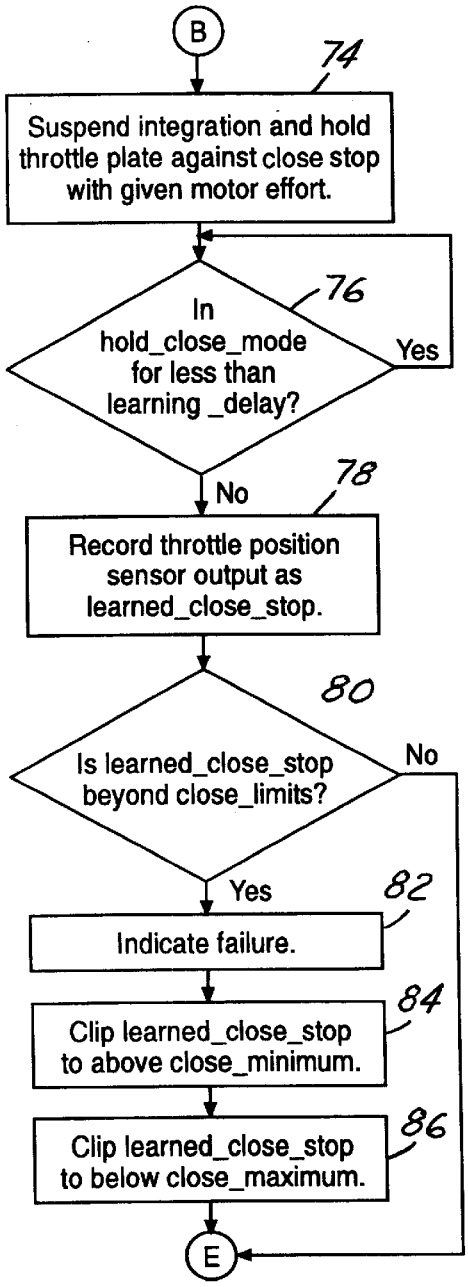
FIG. 2C is a flow chart depicting a method of providing electronic throttle servo hard stop detection system for a hold close mode in accordance with one embodiment of the present invention.

Referring to FIG. 2C, a flow chart depicting a method of providing electronic throttle servo hard stop detection system for hold close mode in accordance with one embodiment of the present invention is illustrated. The hold close mode sequence begins with step 74 by suspending integration and assuming open loop control mode. In this step, the controller transitions from a closed loop control mode to an open loop control mode. Once the controller has shifted to the open loop control mode, the throttle motor holds the throttle plate against the close stop. Then, the sequence then proceeds to step 76.

In step 76, the controller determines if the throttle plate has been in the hold close mode for less than a learning delay. A learning delay allows for the throttle plate to stabilize and typically lasts for about 60 milliseconds. Once the learning delay has expired, the sequence proceeds to step 78.

In step 78, the controller records the throttle position sensor output as the learned close stop. The sequence then proceeds to step 80.

In step 80, the controller determines if the learned close stop is beyond a predetermined limit. For example, close stop limits may include a minimum of 4 degrees and a maximum of 12 degrees. If the controller determines that the learned close stop is within these limits, the sequence immediately proceeds to step 42. If, however, the learned close stop is beyond these limits, then the sequence proceeds to step 82.

In step 82, the controller indicates a failure. The sequence then proceeds to steps 84 and 86. In these steps, the controller clips the learned close stop so as to restrict the learned close stop to a range above a close stop minimum and below a close stop maximum. A typical close stop minimum has a value of 4 degrees, and a common close stop maximum has a value of 12 degrees. Then, the sequence returns to step 42.

Figure 2D:
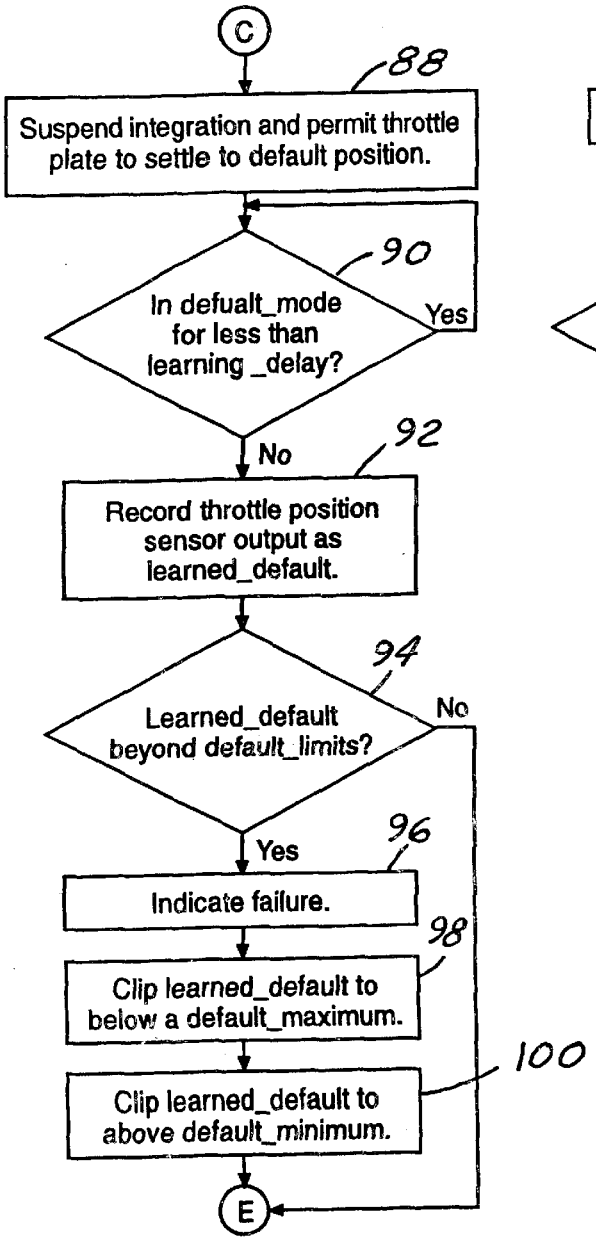
FIG. 2D is a flow chart depicting a method of providing electronic throttle servo hard stop detection system for default mode in accordance with one embodiment of the present invention.

Referring to FIG. 2D, a flow chart depicting a method to relearn the throttle position sensor output associated with default in accordance with one embodiment of the present invention is illustrated. The default mode sequence begins with step 88 by suspending integration and assuming open loop control mode. In this step, the controller applies zero volts to the motor to allow the throttle plate to settle to a default position. Then, the sequence proceeds to step 90.

In step 90, the controller determines if the throttle plate has been in default mode for less than a learning delay. A learning delay allows for the throttle plate to stabilize and typically lasts for about 60 milliseconds. Once the learning delay has expired, the sequence proceeds to step 92.

In step 92, the controller records the throttle position sensor output as the default stop. The sequence then proceeds to step 94.

In step 94, the controller determines if the default stop is beyond a predetermined limit. For example, default limits may include a minimum of 6 degrees and a maximum of 10 degrees greater than close stop. If the controller determines that the default stop is within these limits, the sequence immediately proceeds to step 42. If, however, the default stop is beyond these limits, then the sequence proceeds to step 96.

In step 96, the controller indicates a failure. The sequence then proceeds to steps 98 and 100. In these steps, the controller clips the learned default so as to restrict the learned default to a range above a default minimum and below a default maximum. A typical default minimum has a value of 6 degrees above close stop, and a common default maximum has a value of 10 degrees above close stop. Then, the sequence returns to step 42.

Figure 2E:
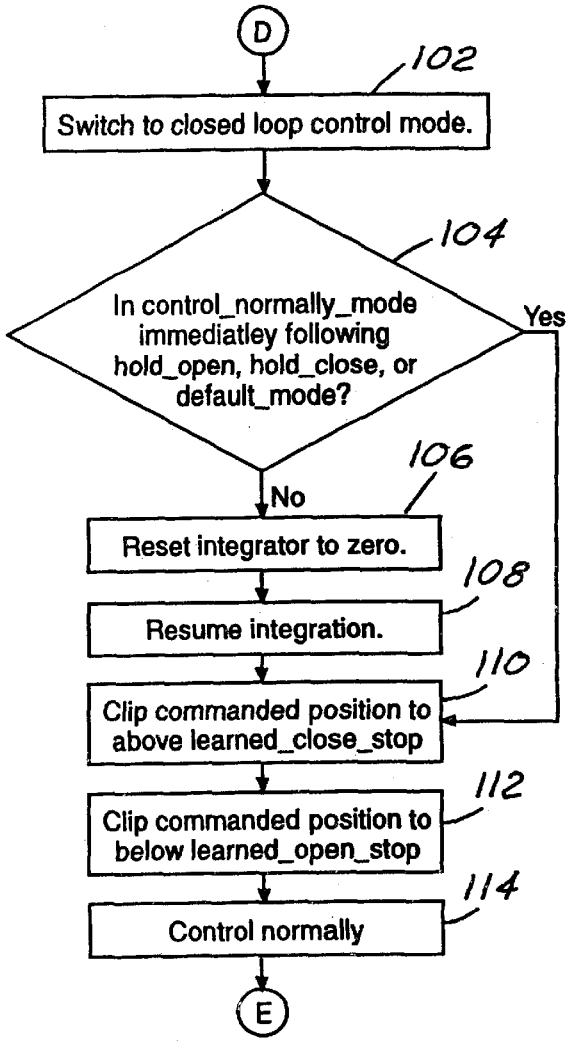
FIG. 2E is a flow chart depicting a method of providing electronic throttle servo hard stop detection system for a control normal mode in accordance with one embodiment of the present invention.

Referring to FIG. 2E, a flow chart depicting a method of providing an electronic throttle servo hard stop detection system for normal mode in accordance with one embodiment of the present invention is illustrated. The control normal mode sequence begins with step 102. In this step, the controller enters or re-enters closed loop control mode. Then the sequence proceeds to step 104.

In step 104, the controller determines if the immediately preceding mode was one of a hold open, hold close, or default mode. If the answer is negative, then the sequence immediately proceeds to steps 106. In step 106, the controller resets the integrator to zero for initialization. Then the controller proceeds to step 108. In step 108, the controller resumes integration. The sequence immediately proceeds to step 110.

If in step 104 the answer is positive, then the sequence proceeds directly to step 110. In step 110, the controller clips the commanded position above the learned close stop. Then the sequence proceeds to step 112. In step 112, the controller clips commanded position below the learned open stop. Then, the sequence proceeds to step 114. In step 114, the controller controls the throttle plate normally. Then, the sequence proceeds to step 42.

In operation, a position command signal is first input into the controller. Discontinuity positions for throttle close stop, throttle open stop and throttle default are also established. The throttle position outputs at each of the aforementioned discontinuities are then relearned during throttle operation.

Learning of the throttle position sensor output corresponding to close stop is critical for operation of the controller in embodiments that include control relative to close stop. Learning of the throttle sensor position output corresponding to default is critical because a discontinuity exists at that point. The throttle spring force is "opening" below default, is zero at default, and is "closing" above default. Thus, the feed-forward term (or in another configuration, the spring nulling term) is negative below default, zero at default, and positive above default. For this reason, it is important to know if the throttle command (in alternate configurations, the actual throttle position) is above, at, or below the default position. Learning this value on-line (while the throttle is operating) increases the controller robustness to changes occurring during throttle operation.

Following the learning step, a short term force may be applied to the throttle through the controller to crush debris before re-learning the throttle position sensor output corresponding to close or open stop, as discussed previously.

On-line default position re-learning is subsequently accomplished through controller logic. This logic is operative to drive the controller into an open loop mode (zero force) and then relearn the throttle position sensor output that corresponds to the default position. When the true default angle is significantly different from the present commanded position, which moved the controller into the re-learn default mode, the actual position varies significantly from the commanded position. When the absolute value of the difference between commanded position and the actual throttle position is larger than a desired angle, a different process is taken, the direction of throttle movement is noted, and the learned default position is incremented in that direction. Normal close loop control is subsequently resumed.

Once the three discontinuities are learned, their respective possible range values are limited to a user defined reasonable value to insure that the system works properly. For example, unusual behavior may result if some of the three learned positions are out of order or coincident. The controller optimally operates with a clipped range of possible values. If any of the learned throttle position voltages corresponding to the three discontinuities are out of the expected ranges (some manufacturing variation is allowed), then failure indicators are set.

A further use of the learned throttle position outputs of the close stop and open stop is that they prevent high velocity strikes of either stop. They accomplish this by clipping the commanded position to a maximum value of the learned open stop and a minimum value of learned close stop. Should a commanded position lower than close stop exist in the system, the commanded position is clipped to close stop. The controller eventually enters the hold close mode. Should, at that time, the throttle move to a position lower than the previous close stop, that value is relearned through the aforementioned algorithm, which continuously learns close stop while in hold close mode. The apparent close stop may be reduced due to a removal of a foreign object (such as ice) from the throttle.

An analogous situation occurs with the open stop. Should a commanded position higher than open stop be commanded, the commanded position is then clipped to open stop. The controller eventually enters the hold open mode. Should the throttle move to a position higher than the previous open stop, that new value is relearned per the aforementioned process, which continuously learns open stop while in hold open mode. The apparent open stop may increase due to a removal of a foreign object (such as ice) from the throttle.

The commanded position is clipped between the open and close stops. Resultantly, the commanded position is never beyond the learned stop values. The controller is further calibrated such that overshoot is controlled so the throttle plate rotational velocity does not exceed a desired value when the commanded position is at or beyond the actual throttle position.

The integral term is free to act during normal close loop control. When in open loop mode (when the throttle is at one of the three discontinuities), the controller suspends the integrator to prevent integrator windup. Additionally, the controller resets the integrator upon leaving hold close or hold open mode. This is advantageous because as the controller takes time to discover that the throttle is against the stop, the integrator winds up. When normal operation resumes, it resumes with a wound up integrator value, which causes an unnecessary transient error as the integrator subsequently unwinds. This problem is prevented by resetting the integrator term to zero as hold open or hold close mode is exited.

The present invention thus achieves an improved and reliable electronic throttle servo hard stop detection system by monitoring when the closing or opening control effort exceeds a threshold for a given amount of time. In this way, the present invention allows full control effort while preventing overheat conditions. Additionally, the present invention does not cause mechanism failure or require significant and costly added robustness to the mechanism.

From the foregoing, it can be seen that there has been brought to the art a new and improved electronic throttle servo hard stop detection system. It is to be understood that the preceding description of the preferred embodiment is merely illustrative of some of the many specific embodiments that represent applications of the principles of the present invention. Clearly, numerous and other arrangements would be evident to those skilled in the art without departing from the scope of the invention as defined by the following claims.

What is claimed is:

1. A method for controlling a positioning device of an internal combustion engine, the method comprising:

providing an electric motor for actuating the positioning device;

commanding the positioning device to change to a commanded position;

detecting a control effort required to change to said commanded position;

determining whether said control effort exceeds a threshold for a predetermined time period;

reducing said control effort when said control effort exceeds said threshold for said predetermined time period;

commanding the positioning device to change to a full stop position; and learning a positioning device voltage at said full stop position.

2. The method as recited in claim 1, wherein the step of commanding the positioning device to change to a commanded position, comprises commanding the positioning device to close to a commanded position.

3. The method as recited in claim 2, further comprising:

detecting an actual position of the positioning device.

4. The method as recited in claim 3, further comprising:

maintaining said control effort when said actual position is a more closed position than said commanded position.

5. The method as recited in claim 4, further comprising:

reversing said control effort when said actual position is a less closed position than said commanded position.

6. The method as recited in claim 1, wherein the step of commanding the positioning device to change to a commanded position, comprises commanding the positioning device to open to a commanded position.

7. The method as recited in claim 6, further comprising:

detecting an actual position of the positioning device.

8. The method as recited in claim 7, further comprising:

maintaining said control effort when said actual position is a more open position than said commanded position.

9. The method as recited in claim 8, further comprising:

reversing said control effort when said actual position is a less open position than said commanded position.

10. A system for controlling a positioning device of an internal combustion engine to prevent overheat conditions, the system comprising:

an electric motor for actuating the positioning device with a control effort;

a control effort detector coupled to said electric motor and detecting said control effort; and a controller coupled to said electric motor and said control effort detector, said controller including control logic operative to command the positioning device to change to a commanded position, detect a control effort required to change to said commanded position, determine whether said control effort exceeds a threshold for a predetermined time period, reduce said control effort when said control effort exceeds said threshold for said predetermined time period, command the positioning device to change to a full stop position, and learn a positioning device voltage at said full stop position.

11. The system as recited in claim 10, wherein said controller further includes control logic operative to command the positioning device to close to a commanded position.

12. The system as recited in claim 11, wherein said controller further includes control logic operative to detect an actual position of the positioning device.

13. The system as recited in claim 12, wherein said controller further includes control logic operative to maintain said control effort when said actual position is a more closed position than said commanded position.

14. The system as recited in claim 13, wherein said controller further includes control logic operative to reverse said control effort when said actual position is a less closed position than said commanded position.

15. The system as recited in claim 10, wherein said controller further includes control logic operative to command the positioning device to change to a commanded position, comprises commanding the positioning device to open to a commanded position.

16. The system as recited in claim 15, wherein said controller further includes control logic operative to detect an actual position of the positioning device.

17. The system as recited in claim 16, wherein said controller further includes control logic operative to maintain said control effort when said actual position is a more open position than said commanded position.

18. The system as recited in claim 17, wherein said controller further includes control logic operative to reverse said control effort when said actual position is a less open position than said commanded position.

19. A method for controlling a throttle comprising the steps of:

inputting a position command signal to a throttle controller;

designating a throttle close stop position;

designating a throttle open stop position;

designating a throttle default position;

learning sensor output corresponding to said throttle close stop position;

controlling the throttle to approximate said throttle close stop position;

learning sensor output corresponding to said throttle open stop position;

controlling the throttle to approximate said throttle open stop position;

learning sensor output corresponding to said throttle default position; and controlling the throttle to approximate said throttle default position.

20. The method as recited in claim 19, wherein the step of designating a throttle close stop position includes the step of clipping said position command signal.

21. The method as recited in claim 19, wherein the step of designating a throttle open stop position includes the step of clipping said position command signal.

22. The method as recited in claim 19, wherein the step of designating a throttle default position includes, the step of clipping said position command signal.

23. The method as recited in claim 19, wherein the step of controlling the throttle to approximate said throttle close stop position includes the step of suspending integration when the throttle is at said throttle close stop position.

24. The method as recited in claim 19, wherein the step of controlling the throttle to approximate said throttle open stop position includes the step of suspending integration when the throttle is at said throttle open stop position.

25. The method as recited in claim 19, wherein the step of controlling the throttle to approximate said throttle default position includes the step of suspending integration when the throttle is at said throttle default position.

* * * * *